US007690976B2

(12) United States Patent
Edidin et al.

(10) Patent No.: US 7,690,976 B2
(45) Date of Patent: Apr. 6, 2010

(54) POKER GAME METHOD AND APPARATUS

(75) Inventors: Orrin J. Edidin, Northbrook, IL (US); Allon G. Englman, Chicago, IL (US); Jeremy M. Hornik, Chicago, IL (US); Michael W. Mastropietro, Chicago, IL (US)

(73) Assignee: WMS Gaming Inc., Waukegan, IL (US)

( * ) Notice: Subject to any disclaimer, the term of this patent is extended or adjusted under 35 U.S.C. 154(b) by 946 days.

(21) Appl. No.: 11/125,901

(22) Filed: May 10, 2005

(65) Prior Publication Data

US 2006/0258425 A1 Nov. 16, 2006

(51) Int. Cl.
*A63F 9/24* (2006.01)

(52) U.S. Cl. ..... 463/13; 273/292

(58) Field of Classification Search ..... 463/12–13; 273/292

See application file for complete search history.

(56) References Cited

U.S. PATENT DOCUMENTS

| | | | |
|---|---|---|---|
| 4,743,022 | A | 5/1988 | Wood |
| 4,836,553 | A | 6/1989 | Suttle et al. |
| 4,948,134 | A | 8/1990 | Suttle et al. |
| 5,022,653 | A | 6/1991 | Suttle et al. |
| 5,042,818 | A | 8/1991 | Weingardt |
| 5,123,649 | A | 6/1992 | Tiberio |
| 5,255,915 | A | 10/1993 | Miller |
| 5,294,120 | A | 3/1994 | Schultz |
| 5,308,065 | A | 5/1994 | Bridgeman et al. |
| 5,322,295 | A | 6/1994 | Cabot et al. |
| 5,401,023 | A | 3/1995 | Wood |
| 5,431,408 | A | 7/1995 | Adams |
| 5,437,451 | A | 8/1995 | Fulton |
| 5,489,101 | A | 2/1996 | Moody |
| 5,511,781 | A | 4/1996 | Wood et al. |
| 5,531,440 | A | 7/1996 | Dabrowski et al. |
| 5,531,441 | A | 7/1996 | Dabrowski et al. |
| 5,531,448 | A | 7/1996 | Moody |
| 5,636,843 | A | 6/1997 | Roberts |
| 5,707,285 | A | 1/1998 | Place et al. |
| 5,732,950 | A | 3/1998 | Moody |
| 5,816,916 | A | 10/1998 | Moody |
| 5,823,873 | A | 10/1998 | Moody |
| 5,868,619 | A | 2/1999 | Wood et al. |

(Continued)

FOREIGN PATENT DOCUMENTS

| | | |
|---|---|---|
| WO | WO 97/27570 | 7/1997 |

OTHER PUBLICATIONS

Draw Poker Variants, web page (6 pages).

*Primary Examiner*—Peter DungBa Vo
*Assistant Examiner*—Alex F. R. P. Rada, II
(74) *Attorney, Agent, or Firm*—Nixon Peabody LLP

(57) ABSTRACT

A method of playing a poker game comprises receiving a primary wager to initiate game play and displaying a first card hand formed from a first group of cards. The method further comprises evaluating whether the first card hand is a winning hand payable according to a paytable. The method further comprises displaying a second card hand formed from a second group of cards, and if the second card hand satisfies a bonus award criteria, awarding a bonus award. In an embodiment, the first card hand comprises five cards and the second card hand comprises two cards.

7 Claims, 10 Drawing Sheets

U.S. PATENT DOCUMENTS 5,882,259 A 3/1999 Holmes, Jr. et al.
5,941,770 A 8/1999 Miers et al.
5,954,335 A 9/1999 Moody
5,957,774 A 9/1999 Holmes, Jr. et al.
5,976,016 A 11/1999 Moody et al.
6,007,066 A 12/1999 Moody
6,012,720 A 1/2000 Webb
6,045,129 A 4/2000 Cooper et al.
6,098,985 A 8/2000 Moody
6,110,040 A 8/2000 Sanduski et al.
6,120,378 A 9/2000 Moody et al.
6,132,311 A 10/2000 Williams
6,149,521 A 11/2000 Sanduski
6,196,918 B1 3/2001 Miers et al.
6,206,780 B1 3/2001 Awada
6,237,916 B1 5/2001 Webb
6,248,016 B1 6/2001 Walker et al.
6,257,979 B1 7/2001 Walker et al.
6,336,860 B1 1/2002 Webb
6,406,369 B1 6/2002 Baerlocher et al.
6,416,407 B1 7/2002 Carrico et al.
6,419,578 B1 7/2002 Moody et al.
6,461,240 B1 10/2002 Perkins et al.
6,471,587 B1 10/2002 Wood et al.
6,474,645 B2 11/2002 Tarantino
6,494,454 B2 12/2002 Adams
6,511,068 B1 * 1/2003 Sklansky et al. ..... 273/237
6,561,898 B2 5/2003 Moody
6,569,013 B1 5/2003 Taylor
6,569,014 B2 5/2003 Walker et al.
6,595,520 B1 7/2003 Richards et al.
6,595,852 B2 7/2003 Wang
6,612,926 B1 9/2003 Dabrowski
6,612,927 B1 9/2003 Slomiany et al.
6,616,142 B2 9/2003 Adams
6,637,747 B1 10/2003 Garrod
6,672,958 B2 1/2004 Bennett
6,672,959 B2 1/2004 Moody et al.
6,685,560 B1 2/2004 Hughes
6,695,695 B2 * 2/2004 Angel ..... 463/13
6,708,975 B1 3/2004 Fox et al.
6,726,427 B2 4/2004 Jarvis et al.
6,743,096 B2 6/2004 Allendorf et al.
6,755,736 B2 6/2004 Yang
6,776,713 B2 8/2004 Gauselmann
6,780,106 B2 8/2004 DeMar et al.
6,857,959 B1 2/2005 Nguyen
2002/0034974 A1 3/2002 Wood et al.
2002/0169015 A1 11/2002 Moody
2002/0185816 A1 12/2002 Moody et al.
2003/0032469 A1 2/2003 Moody et al.
2003/0038425 A1 2/2003 Tarantino
2003/0064773 A1 4/2003 Baerlocher et al.
2003/0114219 A1 6/2003 McClintic
2003/0119572 A1 6/2003 Moody et al.
2003/0153377 A1 8/2003 Lisowski, Sr.
2003/0166411 A1 9/2003 Moody
2003/0181232 A1 9/2003 Peccole, Jr.
2003/0186733 A1 10/2003 Wolf et al.
2003/0189290 A1 10/2003 Moody
2003/0214097 A1 11/2003 Moody
2004/0038733 A1 * 2/2004 Walker et al. ..... 463/25
2004/0043807 A1 3/2004 Pennington
2004/0072608 A1 * 4/2004 Toyoda ..... 463/17
2004/0132524 A1 7/2004 Ramstad et al.
2004/0248641 A1 12/2004 Jarvis et al.
2004/0259621 A1 * 12/2004 Pfeiffer et al. ..... 463/13
2005/0110215 A1 * 5/2005 Jackson ..... 273/292
2006/0068899 A1 * 3/2006 White et al. ..... 463/25
2006/0178183 A1 * 8/2006 Van Asdale ..... 463/13
2006/0205484 A1 9/2006 Nicastro
2006/0246976 A1 * 11/2006 Sines ..... 463/13

* cited by examiner

POKER GAME METHOD AND APPARATUS

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming machines, and methods for playing wagering games, and more particularly, to a gaming machine for playing a poker game including a bonus hand and a bonus poker game having multiple rounds of play against virtual opponents.

BACKGROUND OF THE INVENTION

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, gaming machine manufacturers continuously develop new games and improved gaming enhancements that will attract frequent play through enhanced entertainment value to the player.

One concept that has been successfully employed to enhance the entertainment value of a game is the concept of a "secondary" or "bonus" game that may be played in conjunction with a "basic" game. The bonus game may comprise any type of game, either similar to or completely different from the basic game, which is entered upon the occurrence of a selected event or outcome in the basic game. Generally, bonus games provide a greater expectation of winning than the basic game and may also be accompanied with more attractive or unusual video displays and/or audio. Bonus games may additionally award players with "progressive jackpot" awards that are funded, at least in part, by a percentage of coin-in from the gaming machine or a plurality of participating gaming machines. Because the bonus game concept offers tremendous advantages in player appeal and excitement relative to other known games, and because such games are attractive to both players and operators, there is a continuing need to develop gaming machines with new types of bonus games to satisfy the demands of players and operators.

Traditional video poker games have utilized a variety of mechanisms to present various combinations of symbols, and to award prizes, money, or other awards associated with certain predefined winning combinations. Video poker gaming machines offer an alternative wherein winning combinations correspond with traditional winning poker hands. However, traditional video poker machines typically involve only basic play of various poker games and fail to offer a player exciting bonus awards and features often found in video slot machines and other gaming machines. Thus, a need exists for a video poker gaming machine including more exciting and entertaining features. The present invention is directed to satisfying one ore more of these needs and solving other problems.

SUMMARY OF THE INVENTION

According to one aspect of the present invention, a method of playing a poker game comprises receiving a primary wager to initiate game play and displaying a first card hand formed from a first group of cards. The method further includes evaluating whether the first card hand is a winning hand payable according to a paytable. The method includes displaying a second card hand formed from a second group of cards, and if the second card hand satisfies a bonus award criteria, awarding a bonus award.

According to another aspect of the invention, a method of playing a poker game between a player and a plurality of virtual opponents comprises receiving a wager from the player to initiate game play and ranking the player and the virtual opponents. The method further includes displaying a first player hand formed by a plurality of cards selected from a group of cards and displaying a first opponent hand formed by a plurality of cards selected from the group of cards. The method includes displaying a plurality of community cards selected from the group of cards and evaluating the first player hand against the first opponent hand. If the first player hand beats the first opponent hand, the method includes displaying a second player hand formed by a plurality of cards selected from the group of cards, displaying a second opponent hand formed by a plurality of cards selected from the group of cards, and increasing the player's ranking.

According to yet another aspect of the invention, a computer readable storage medium is encoded with instructions for directing a gaming device to perform the above methods.

Additional aspects of the invention will be apparent to those of ordinary skill in the art in view of the detailed description of various embodiments, which is made with reference to the drawings, a brief description of which is provided below.

DETAILED DESCRIPTION

Figure 1:
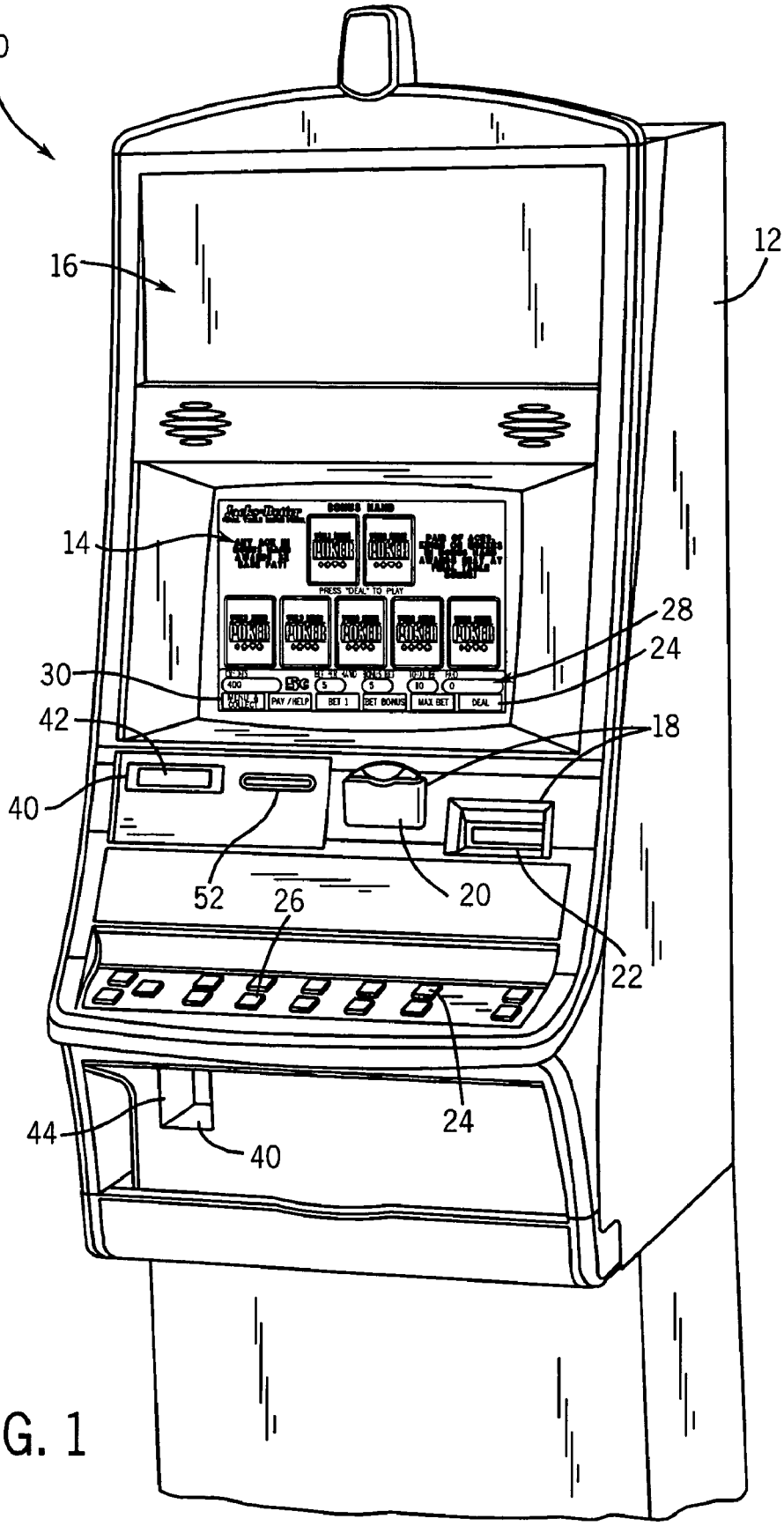
FIG. 1 is a perspective view of a gaming machine embodying the present invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring to FIG. 1, a gaming machine 10 is used in gaming establishments such as casinos. With regard to the present invention, the gaming machine 10 may be any type of gaming machine and may have varying structures and methods of operation. For example, the gaming machine 10 may be an electromechanical gaming machine configured to play mechanical slots, or it may be an electronic gaming machine configured to play a video casino game, such as blackjack, slots, keno, poker, blackjack, roulette, etc.

The gaming machine 10 comprises a housing 12 and includes input devices, including a value input device 18 and a player input device 24. For output the gaming machine 10 includes a primary display 14 for displaying information about the basic wagering game. The primary display 14 can also display information about a bonus wagering game and a progressive wagering game. The gaming machine 10 may also include a secondary display 16 for displaying game events, game outcomes, and/or signage information. While these typical components found in the gaming machine 10 are described below, it should be understood that numerous other elements may exist and may be used in any number of combinations to create various forms of a gaming machine 10.

The value input device 18 may be provided in many forms, individually or in combination, and is preferably located on the front of the housing 12. The value input device 18 receives currency and/or credits which are inserted by a player. The value input device 18 may include a coin acceptor 20 for receiving coin currency (see FIG. 1). Alternatively, or in addition, the value input device 18 may include a bill acceptor 22 for receiving paper currency. Furthermore, the value input device 18 may include a ticket reader, or barcode scanner, for reading information stored on a credit ticket, a card, or other tangible portable credit storage device. The credit ticket or card may also authorize access to a central account, which can transfer money to the gaming machine 10.

The player input device 24 comprises a plurality of push buttons 26 on a button panel for operating the gaming machine 10. In addition, or alternatively, the player input device 24 may comprise a touch screen 28 mounted by adhesive, tape, or the like over the primary display 14 and/or secondary display 16. The touch screen 28 contains soft touch keys 30 denoted by graphics on the underlying primary display 14 and used to operate the gaming machine 10. The touch screen 28 provides players with an option on how to make their game selections. A player enables a desired function either by touching the touch screen 28 at an appropriate touch key 30 or by pressing an appropriate push button 26 on the button panel. The touch keys 30 may be used to implement the same functions as push buttons 26. Alternatively, the push buttons 26 may provide inputs for one aspect of the operating the game, while the touch keys 30 may allow for input needed for another aspect of the game.

The various components of the gaming machine 10 may be connected directly to, or contained within, the housing 12, as seen in FIG. 1, or may be located outboard of the housing 12 and connected to the housing 12 via a variety of different wired or wireless connection methods. Thus, the gaming machine 10 comprises these components whether housed in the housing 12, or outboard of the housing 12 and connected remotely.

The operation of the basic wagering game is displayed to the player on the primary display 14. The primary display 14 can also display the bonus game associated with the basic wagering game, which in a preferred embodiment is a poker card game. The primary display 14 may take the form of a cathode ray tube (CRT), a high resolution LCD, a plasma display, an LED, or any other type of display suitable for use in the gaming machine 10. As shown, the primary display 14 includes the touch screen 28 overlaying the entire monitor (or a portion thereof) to allow players to make game-related selections. Alternatively, the primary display 14 of the gaming machine 10 may include a number of card positions to display the outcome of the poker game. In the illustrated embodiment, the gaming machine 10 is an "upright" version in which the primary display 14 is oriented vertically relative to the player. Alternatively, the gaming machine may be a "slant-top" version in which the primary display 14 is slanted at about a thirty-degree angle toward the player of the gaming machine 10.

A player begins play of the basic wagering game by making a wager via the value input device 18 of the gaming machine 10. A player can select play by using the player input device 24, via the buttons 26 or the touch screen keys 30. The basic game consists of a plurality of cards arranged in an array of card positions that indicate one or more outcomes of the basic game. Such outcomes are randomly selected in response to the wagering input by the player. At least one of the plurality of randomly-selected outcomes may be a start-bonus outcome, which can include any variations of symbols or symbol combinations triggering a bonus game.

In some embodiments, the gaming machine 10 may also include a player information reader 52 that allows for identification of a player by reading a card with information indicating his or her true identity. The player information reader 52 is shown in FIG. 1 as a card reader, but may take on many forms including a ticket reader, bar code scanner, RFID transceiver or computer readable storage medium interface. Currently, identification is generally used by casinos for rewarding certain players with complimentary services or special offers. For example, a player may be enrolled in the gaming establishment's loyalty club and may be awarded certain complimentary services as that player collects points in his or her player-tracking account. The player inserts his or her card into the player information reader 52, which allows the casino's computers to register that player's wagering at the gaming terminal 10. The gaming terminal 10 may use the secondary display 16 or other dedicated player-tracking display for providing the player with information about his or her account or other player-specific information. Also, in some embodiments, the information reader 52 may be used to restore game assets that the player achieved and saved during a previous game session.

Figure 2:
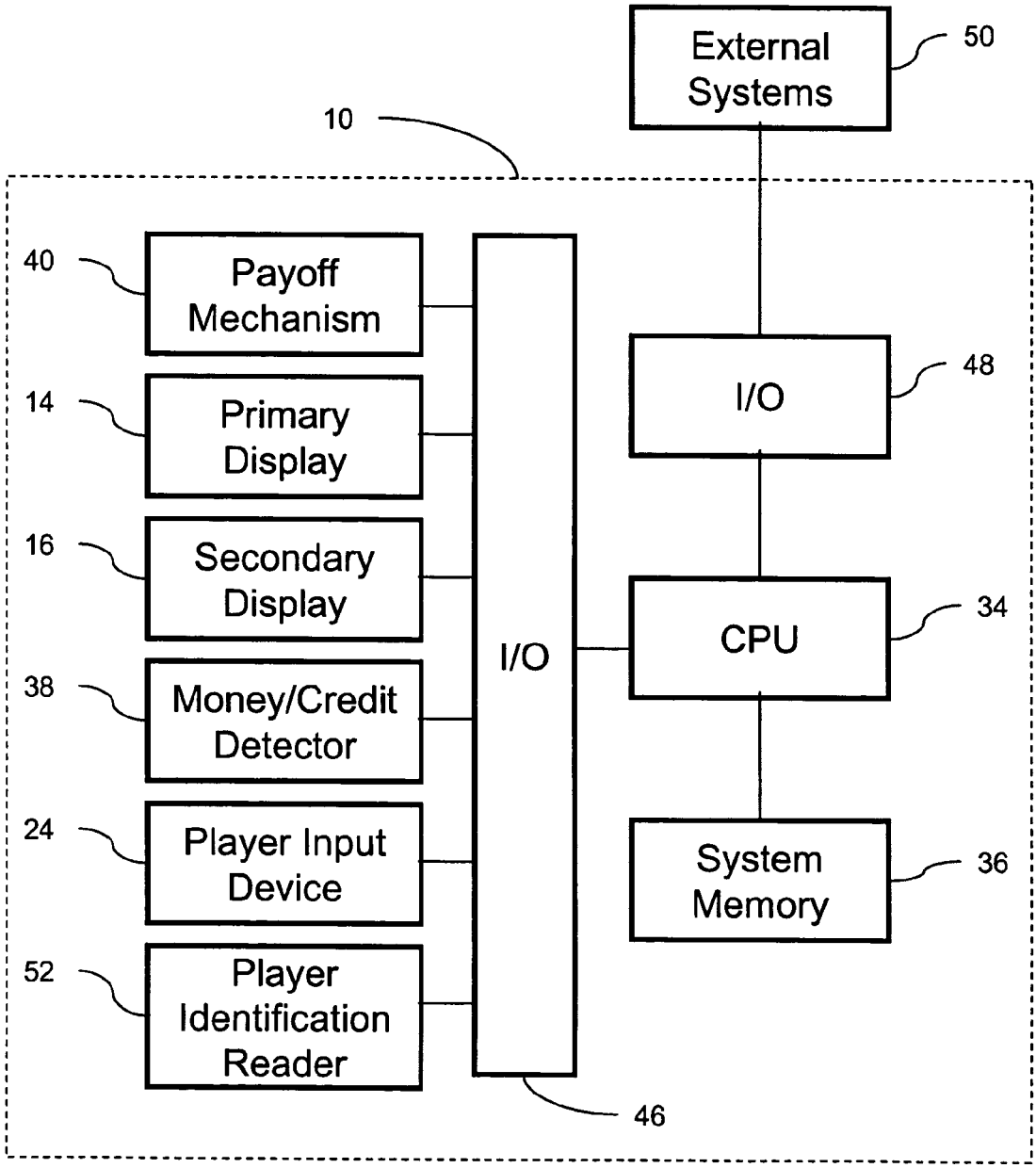
FIG. 2 is a block diagram of a control system suitable for operating the gaming machine.

Turning now to FIG. 2, the various components of the gaming machine 10 are controlled by a central processing unit (CPU) 34, also referred to herein as a controller or processor (such as a microcontroller or microprocessor). To provide gaming functions, the controller 34 executes one or more game programs stored in a computer readable storage medium, in the form of memory 36. The controller 34 performs the random selection (using a random number generator (RNG)) of an outcome from the plurality of possible outcomes of the wagering game. Alternatively, the random event may be determined at a remote controller. The remote controller may use either an RNG or pooling scheme for its central determination of a game outcome. It should be appreciated that the controller 34 may include one or more microprocessors, including but not limited to a master processor, a slave processor, and a secondary or parallel processor.

The controller 34 is also coupled to the system memory 36 and a money/credit detector 38. The system memory 36 may comprise a volatile memory (e.g., a random-access memory (RAM)) and a non-volatile memory (e.g., an EEPROM). The system memory 36 may include multiple RAM and multiple program memories. The money/credit detector 38 signals the processor that money and/or credits have been input via the value input device 18. Preferably, these components are located within the housing 12 of the gaming machine 10. However, as explained above, these components may be located outboard of the housing 12 and connected to the remainder of the components of the gaming machine 10 via a variety of different wired or wireless connection methods.

As seen in FIG. 2, the controller 34 is also connected to, and controls, the primary display 14, the player input device 24, and a payoff mechanism 40. The payoff mechanism 40 is operable in response to instructions from the controller 34 to award a payoff to the player in response to certain winning outcomes that might occur in the basic game or the bonus game(s). The payoff may be provided in the form of points, bills, tickets, coupons, cards, etc. For example, in FIG. 1, the payoff mechanism 40 includes both a ticket printer 42 and a coin outlet 44. However, any of a variety of payoff mechanisms 40 well known in the art may be implemented, including cards, coins, tickets, smartcards, cash, etc. The payoff amounts distributed by the payoff mechanism 40 are determined by one or more pay tables stored in the system memory 36.

Communications between the controller 34 and both the peripheral components of the gaming machine 10 and external systems 50 occur through input/output (I/O) circuits 46, 48. More specifically, the controller 34 controls and receives inputs from the peripheral components of the gaming machine 10 through the input/output circuits 46. Further, the controller 34 communicates with the external systems 50 via the I/O circuits 48 and a communication path (e.g., serial, parallel, IR, RC, 10bT, etc.). The external systems 50 may include a gaming network, other gaming machines, a gaming server, communications hardware, or a variety of other interfaced systems or components. Although the I/O circuits 46, 48 may be shown as a single block, it should be appreciated that each of the I/O circuits 46, 48 may include a number of different types of I/O circuits.

Controller 34, as used herein, comprises any combination of hardware, software, and/or firmware that may be disposed or resident inside and/or outside of the gaming machine 10 that may communicate with and/or control the transfer of data between the gaming machine 10 and a bus, another computer, processor, or device and/or a service and/or a network. The controller 34 may comprise one or more controllers or processors. In FIG. 2, the controller 34 in the gaming machine 10 is depicted as comprising a CPU, but the controller 34 may alternatively comprise a CPU in combination with other components, such as the I/O circuits 46, 48 and the system memory 36.

Figure 3:
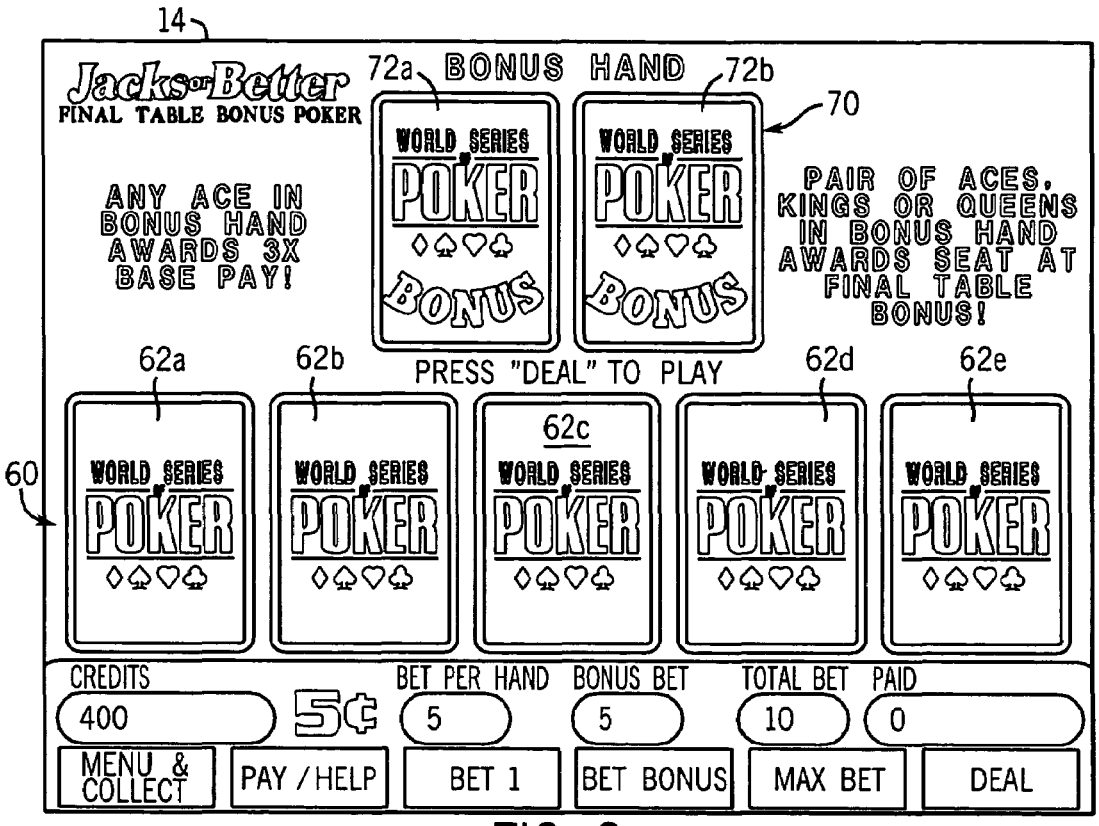
FIG. 3 is a screen display of a poker game.

Turning now to FIG. 3, the primary display 14 of the gaming machine 10 of the present invention is shown depicting the presentation of a poker card game, branded with "World Series of Poker®". The display 14 includes a first, or primary poker hand 60 played by a player of the gaming machine. The first hand 60 comprises a plurality of cards 62*a,b,c,d,e*, which in this embodiment is preferably five cards 62*a,b,c,d,e*. In addition to the first hand 60, the display 14 also includes a second, or bonus poker hand 70. The second hand 70 also comprises a plurality of cards 72*a,b*, which in this embodiment is preferably two cards 72*a,b*. Although the preferred number of cards in the first and second poker hands 60,70 is five and two respectively, any number of cards may be employed. The first card hand 60 is dealt from a first group of cards, preferably a standard deck of fifty-two cards traditionally used to play poker. Similarly, the second hand 70 is dealt from a second group of cards, also preferably a standard deck of fifty-two cards. In this embodiment, the first group of cards and second group of cards are different decks, i.e., two separate decks of cards are used to deal the two hands 60,70. However, it should be understood that even though the first and second groups are separate, both groups may, and preferably do contain the same cards. In this way, the same card may appear in both the first hand 60 (dealt from the first group) and the second hand 70 (dealt from the second group). Alternatively, the first and second groups of cards could be dealt from a single deck.

Figure 4:
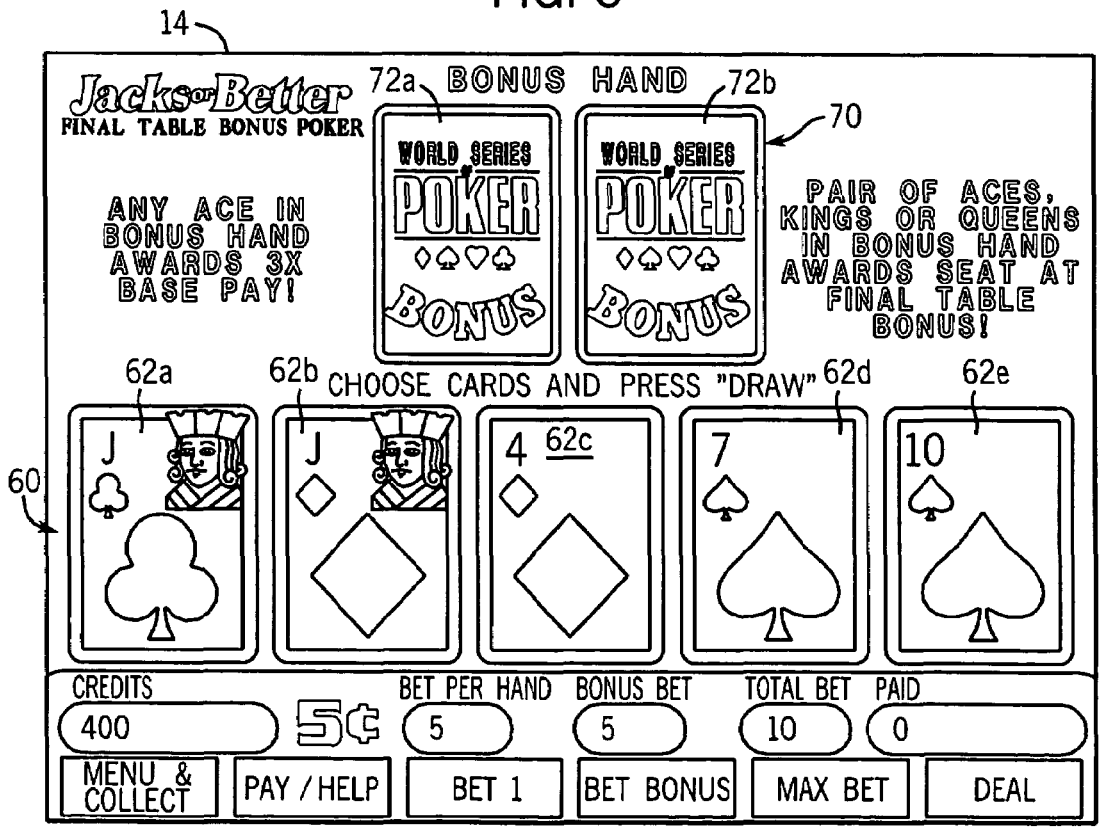
FIG. 4 is a screen display of a poker game displaying a first card hand.

Turning to FIG. 4, once the player has made a wager via the value input device 18, play of the poker game commences. Here, the player has placed a bet of 5 credits, as indicated by the "Bet Per Hand" on the primary display 14. The player is dealt five cards 62*a,b,c,d,e* comprising the first card hand 60. The first card hand 60 is evaluated against a paytable for winning combinations. As indicated in the upper left hand corner of the primary display 14, the paytable is a "Jacks or Better" paytable, indicating that poker hand winning combinations of a pair of jacks or higher in rank are included in the paytable, as is well known in video poker. The paytable includes winning combinations that are the standard ranking of hands in poker ranging from a pair of jacks to a royal flush. Optionally, wild cards may be employed which increases the highest ranking winning hand to five of a kind, wherein the best possible hand is five Aces. Additionally, the depicted embodiment includes a draw option in the play of the first poker hand 60. As is seen in FIG. 4, the display 14 indicates to the player to "Choose Cards and Press 'DRAW'." Thus, in this embodiment, the player may select one or more cards 62 from the first hand 60 to hold, with the non-held cards being discarded and replaced from with sufficient additional cards from the first group, or deck of cards. In this instance, the player selects to hold the two Jacks 62*a,b* and discard the remaining cards 62*c,d,e*.

Figure 5:
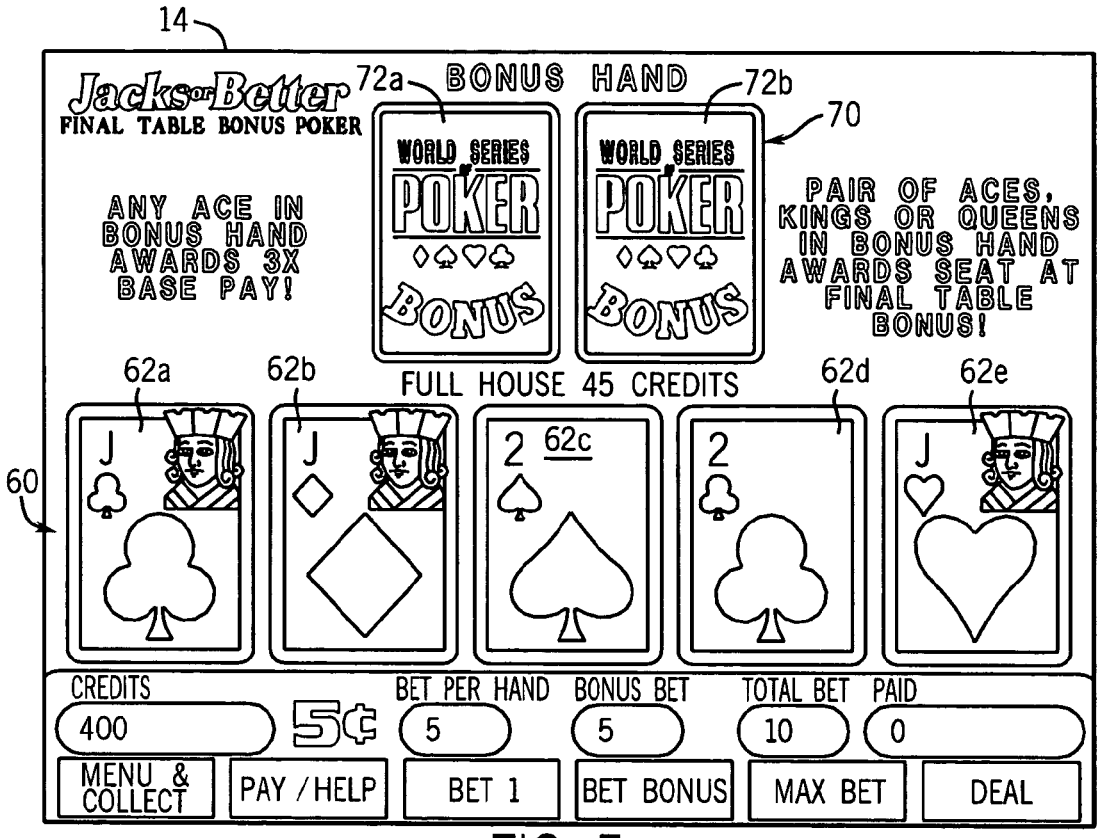
FIG. 5 is a screen display of a poker game displaying a modified first card hand.

In FIG. 5, the discarded cards 62*c,d,e* have been replaced with additional cards from the first group to form a modified first poker hand 60. The result of the draw in this case is that the modified poker hand 60 is a Full House of Jacks and Deuces. As indicated in the center of the primary display 14, the Full House is a winning combination which is paid 45 credits in accordance with the paytable. In addition to the first poker hand 60, the CPU 34 may provide the player the option of playing the bonus poker hand 70, provided certain predefined criteria are satisfied. In this embodiment of the poker game, the player may play the bonus poker hand 70 only if he or she has placed a secondary wager via the value input device 18. As seen in FIG. 5, the player has placed a "Bonus Bet" of 5 credits, and is thus eligible to play the bonus poker hand 70. In alternative embodiments, any number of qualifying criteria may be used to activate play of the bonus poker hand 70. For example, the player may be permitted to play the bonus poker hand 70 only when achieving a winning combination on the first poker hand 60. Alternatively, the bonus hand 70 may be randomly awarded to the player for play.

Figure 6:
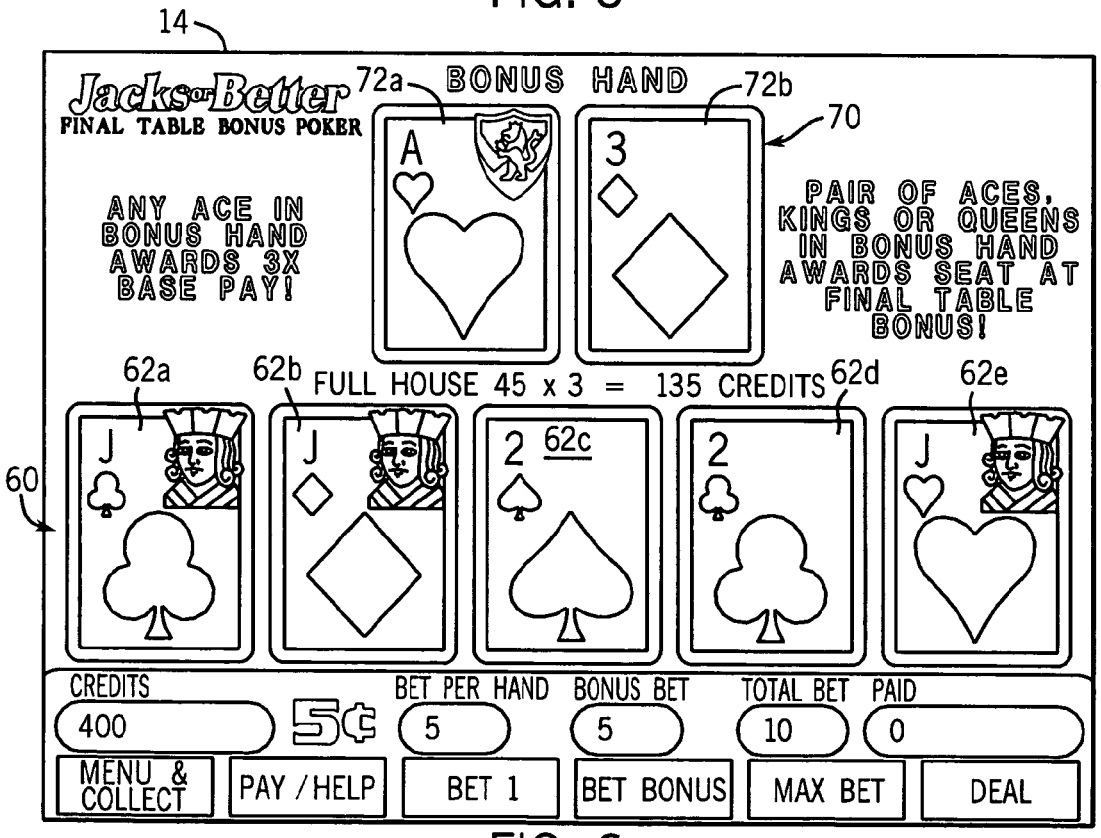
FIG. 6 is a screen display of a poker game displaying a bonus hand.

In FIG. 6, because the player has placed the "Bonus Bet", he is permitted to play the bonus poker hand 70. Two cards 72*a,b* are dealt from a second group of cards to form the bonus hand 70. In this case, the bonus hand 70 comprises the Ace of Hearts 72*a* and the Three of Diamonds 72*b*. The player is awarded a bonus payout if certain winning cards or combinations appear in the bonus hand 70. In this embodiment, the player is awarded a 3× multiplier if any Ace appears in the bonus hand. This criteria is displayed on the upper left hand side of the primary display 14, which indicates "Any Ace in Bonus Hand Awards 3× Base Pay." Thus, the player's 45 credit win for the Full House is multiplied by the 3× multiplier awarded in the bonus hand 70. It is possible for the player to achieve a winning combination in the first poker hand and not receive a bonus win in the bonus hand 70. Alternatively, if a player does not win the first poker hand 60, then any multiplier awarded in the bonus hand 70 would not produce a bonus award, because the base pay in that scenario would be zero. Thus, the bonus pay awarded in the bonus hand 70 is only effective if the player has achieved a winning combination in the first hand 60. However, the poker game may be configured to award the bonus award (e.g. a credit amount) in the bonus hand 70 regardless of the success or failure of the first hand 60.

The bonus hand 70 also serves to trigger a separate bonus poker game, which in this case is entitled the "Final Table Bonus", as seen in FIGS. 8-15. As seen in FIG. 6, the upper right hand corner of the primary display 14 indicates the bonus game trigger criteria: "Pair of Aces, Kings or Queens in Bonus Hand Awards Seat at Final Table Bonus." Thus the bonus hand 70 offers both the opportunity to improve the payout of a winning base pay in the first poker hand 60 (receiving a 3× multiplier for an Ace), as well as the opportunity to play the Final Table Bonus poker game (getting a pair of Aces, Kings or Queens). It should be understood that a variety of different bonus hands 70 (or series of hands) may be used to trigger the bonus poker game. Furthermore, the bonus poker game may be randomly awarded to the player regardless of whether the bonus hand 70 is a bonus game triggering hand or not. Any number of other bonus game triggering techniques may be employed instead of, or in addition to, the qualifying bonus hand 70 trigger.

Figure 7:
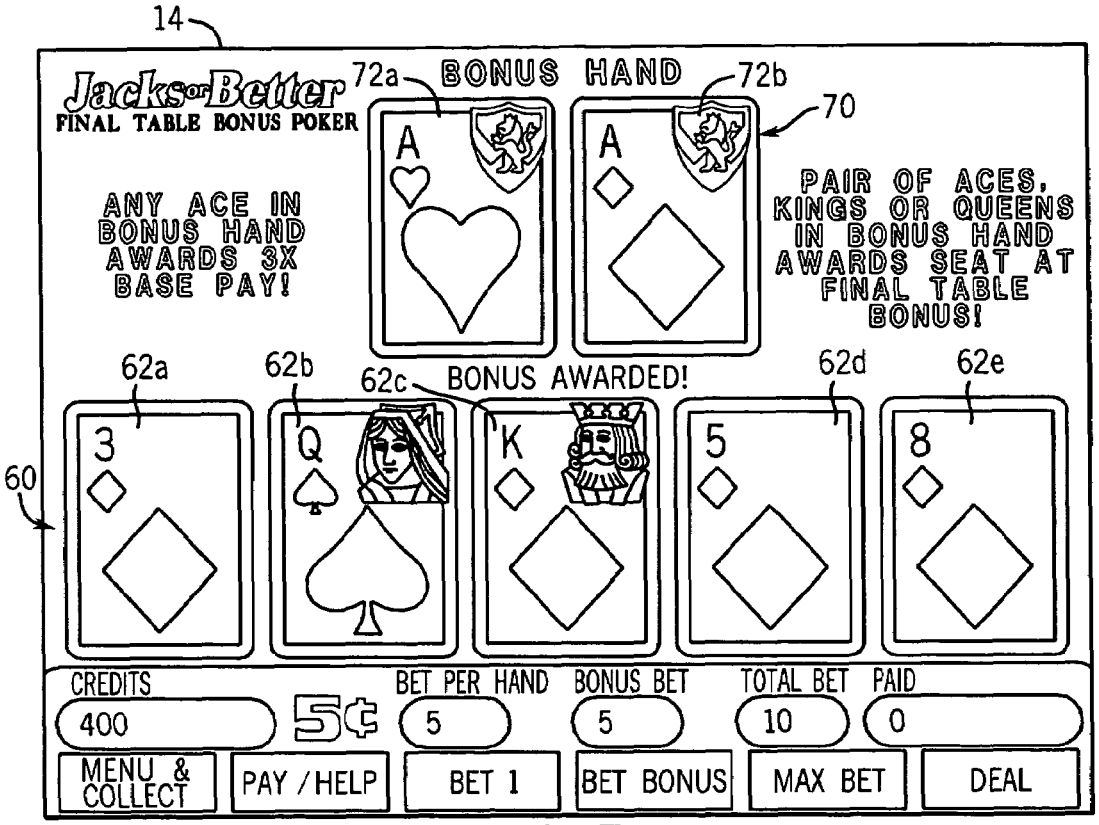
FIG. 7 is a screen display of a poker game displaying a bonus hand triggering a bonus poker game.

In FIG. 7, a subsequent play of the poker game is depicted on the display 14. Here, the player has played the first poker hand 60, but has failed to draw a winning combination. However, because the player has again made the requisite secondary wager (the "Bonus Bet"), he is eligible to be dealt a bonus hand 70. This time the player is dealt a bonus hand 70 of a pair of Aces, triggering the bonus poker game. The primary display 14 indicates to the player that the Final Table Bonus has been triggered by displaying the words "Bonus Awarded" in the center of the screen.

Figure 8:
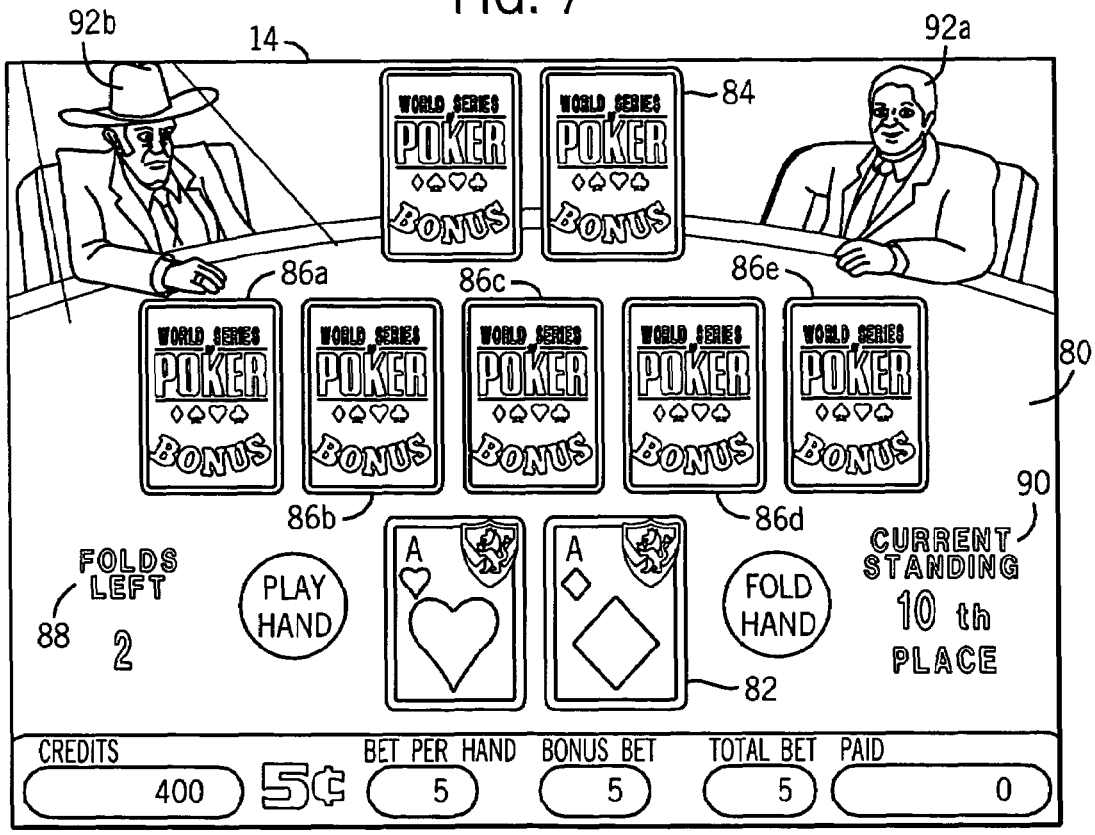
FIG. 8 is a screen display of an initial screen of a bonus poker game.

The primary display 14 then changes to display the Final Table Bonus poker game, as seen in FIG. 8. The Final Table Bonus comprises a poker game including a series of rounds against a plurality of virtual opponents, which in this preferred embodiment is a Texas Hold 'Em poker game. The display 14 includes a poker table 80, the player's hand 82, the opponent's hand 84, and a plurality of community cards 86*a,b,c,d,e*. The player's initial hand 82 comprises the two card bonus hand 70 which triggered the Final Table Bonus, while the opponent's hand 84 comprises another two card hand dealt from the same deck as the bonus hand 70. In other words, the opponent's hand 84 is dealt from the second group of cards as is the triggering bonus hand 70. Each subsequent round of the Final Table Bonus is played between the player and a virtual opponent 92, wherein the player's hand 82, the opponent's hand 84 and the community cards 86 are all dealt from the same deck, or group of cards. Preferably, the deck is a standard deck of fifty two cards which is reshuffled or otherwise randomized between deals. The display 14 further includes a fold meter 88 indicating the number of folds remaining for the player to use, and a standing meter 90, indicating the player's current standing at the final table during the Final Table Bonus. A plurality of virtual opponents 92*a,b* are depicted seated around the poker table 80. Although the bonus poker game described herein is preferably displayed as a bonus game to an underlying base game on a gaming machine, it is understood that the Final Table Bonus game may be employed as the base game on a gaming machine, or as a stand alone game.

At the commencement of the Final Table Bonus, the player's initial hand 82 is the same as the bonus hand 70 that triggered the bonus poker game, in this case a pair of Aces. In this way, the bonus hand 70 that triggered the bonus poker game is "carried over" to the Final Table Bonus, and appears as the player's first hand 82. Because there are only ten players at the final table (the player plus nine virtual opponents), the player commences in $10^{th}$ place, as indicated by the standing meter 90. The fold meter 88 is set to a predetermined level, in this case two. Any pre-determined or random number of folds may be initially awarded to the player and displayed in the fold meter 88. The player must choose to either play his hand 82 against the first virtual opponent 92*b*, or fold the hand 82. In this embodiment, this selection is made via the touch screen by either choosing "Play Hand" or "Fold Hand" as indicated by the primary display 14. Here, the player chooses to play his hand 82, the pair of Aces.

Figure 9:
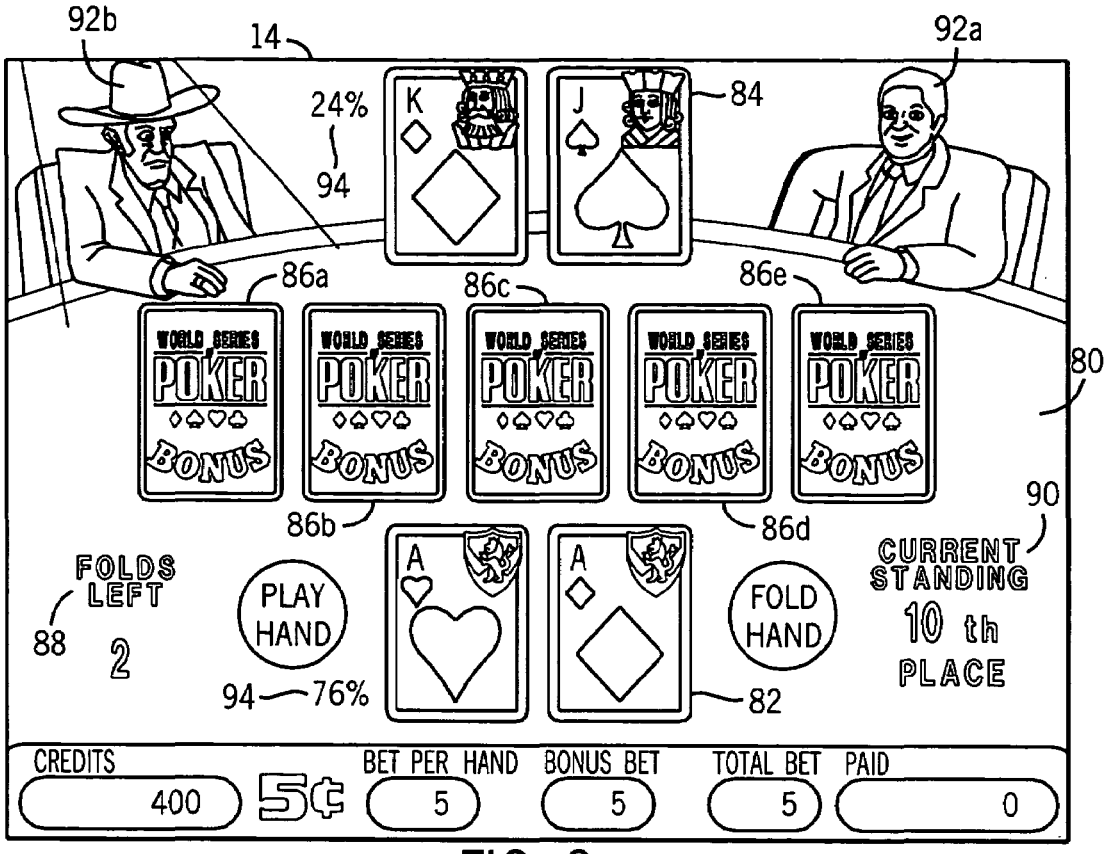
FIG. 9 is a screen display of a bonus poker game displaying a player hand and an opponent hand.

The Final Table Bonus game progresses, as seen in FIG. 9, by displaying the opponent's hand 84, which in this case is a King and a Jack. In addition, the display 14 includes an odds meter 94 positioned next to each of the hands 82,84 indicating the probability that hand 82,84 will be successful against the other. Thus, in FIG. 9, the player's hand 82 of a pair of Aces is statistically favored to win against the opponent's hand 84 of King, Jack seventy-six percent (76%) of the time. The display of the odds meter 94 increases player excitement, particularly when the player's hand 82 is not favored statistically, but results in a winning hand. In this embodiment, the odds meter 94 is displayed only after the opponents' hand 84 is revealed, but prior to displaying any community cards 86 as described later herein. However, the odds meter 94 may be optionally displayed either before the opponent's hand is displayed, after or during the reveal of the community cards 86, or both. The odds meter 94 may optionally be displayed throughout the entire bonus poker game.

Figure 10:
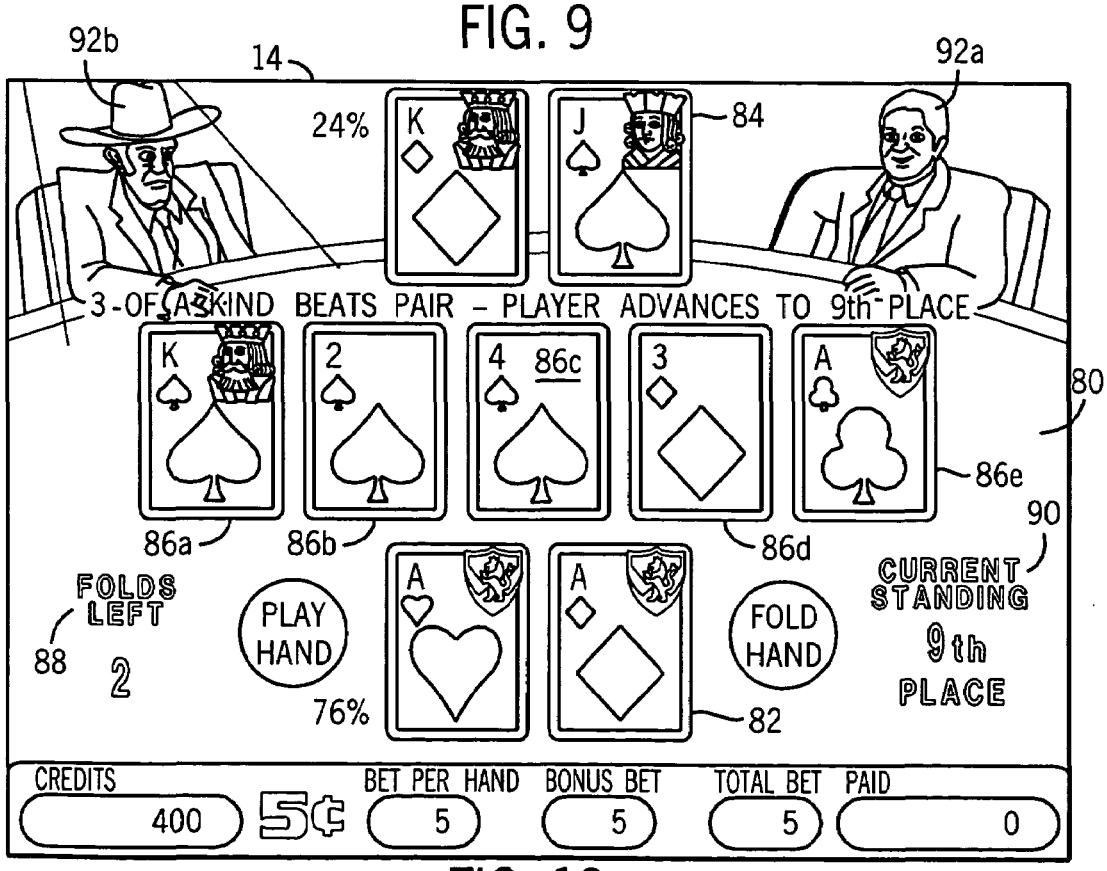
FIG. 10 is a screen display of a bonus poker game displaying community cards.

As seen in FIG. 10, the community cards 86 are then revealed in a predetermined fashion. In this embodiment, the bonus poker game is Texas Hold 'Em, and therefore the community cards 86 are revealed by turning over the first three community cards 86*a,b,c* together (known as the "flop"), subsequently turning over the fourth community card 86*d* (known as the "turn" or "fourth street"), and finally turning over the fifth community card 86*e* (known as the "river" or "fifth street"). Any number of sequences may be used to reveal the community cards 86, including revealing all of the cards 86 at once, one at a time, or in groups of cards 86. Once all of the community cards 86 are displayed, the player hand 82 is evaluated against the opponent's hand 84. The CPU 34 determines the player's best five card poker hand using the two cards in the player's hand 82 and the five community cards 86. The CPU 34 also determines the opponent's 92*b* best five card poker hand using the two cards in the opponents hand 84 and the five community cards 86. The CPU, after evaluating both hands, determines whether or not the player's hand wins. Here, the player has achieved a three of a kind, Aces, which beats the opponent 92*b* who only has a pair of Kings. Thus, the player advances to the next round of the Final Table Bonus. The display 14 indicates to the player his win and advancement in the center of the screen: "3 of a Kind Beats Pair—Player Advances to $9^{th}$ Place." Thus, the standing meter 90 is incremented to indicate the player has advanced from tenth place to ninth place.

Figure 11:
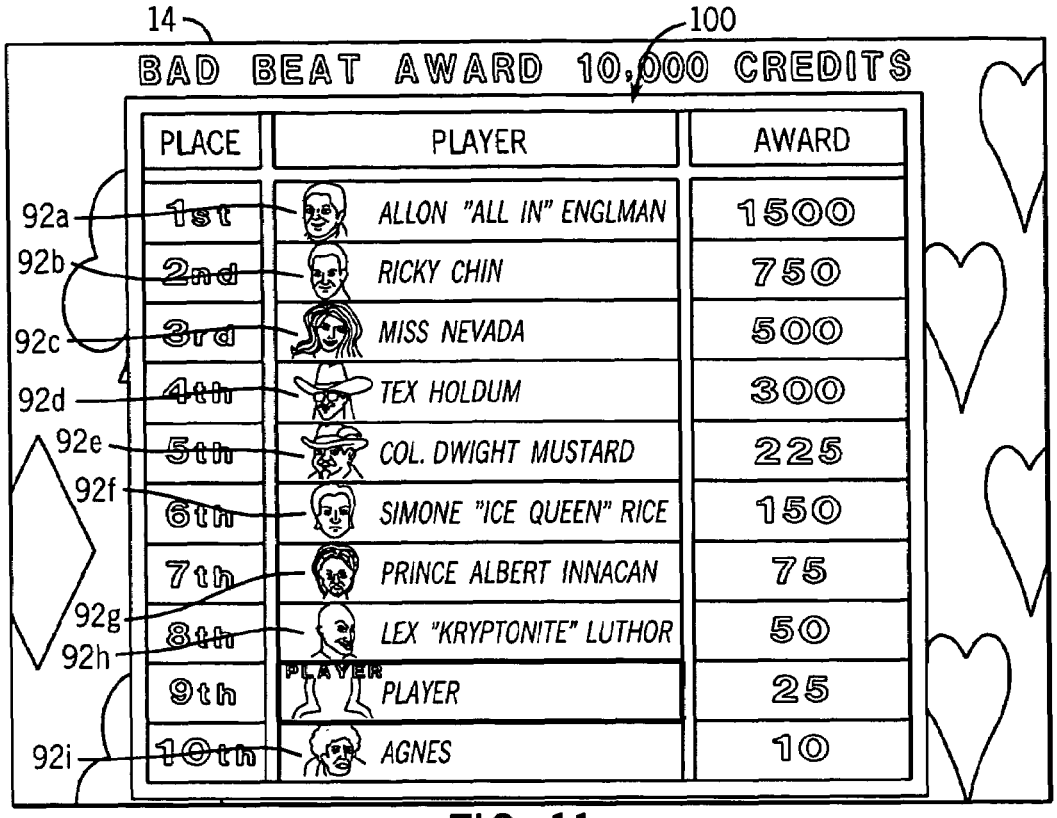
FIG. 11 is a screen display of a paytable for a bonus poker game including player ranking.

A bonus paytable 100 for the Final Table Bonus Game is shown in FIG. 11. The bonus paytable 100 displays the player's standing, the virtual opponents' 92*a-i* standings, and the associated credit award with each standing level. Here, the player has advanced from tenth place to ninth place, and will win at least 25 credits (assuming the player is unable to advance further). With each subsequent round of the bonus poker game, the player faces a new virtual opponent 92, and has an opportunity to advance one more level to a higher bonus game award. If the player successfully defeats all nine virtual opponents 92*a-i*, the player is awarded the top award of 1500 credits.

Figure 12:
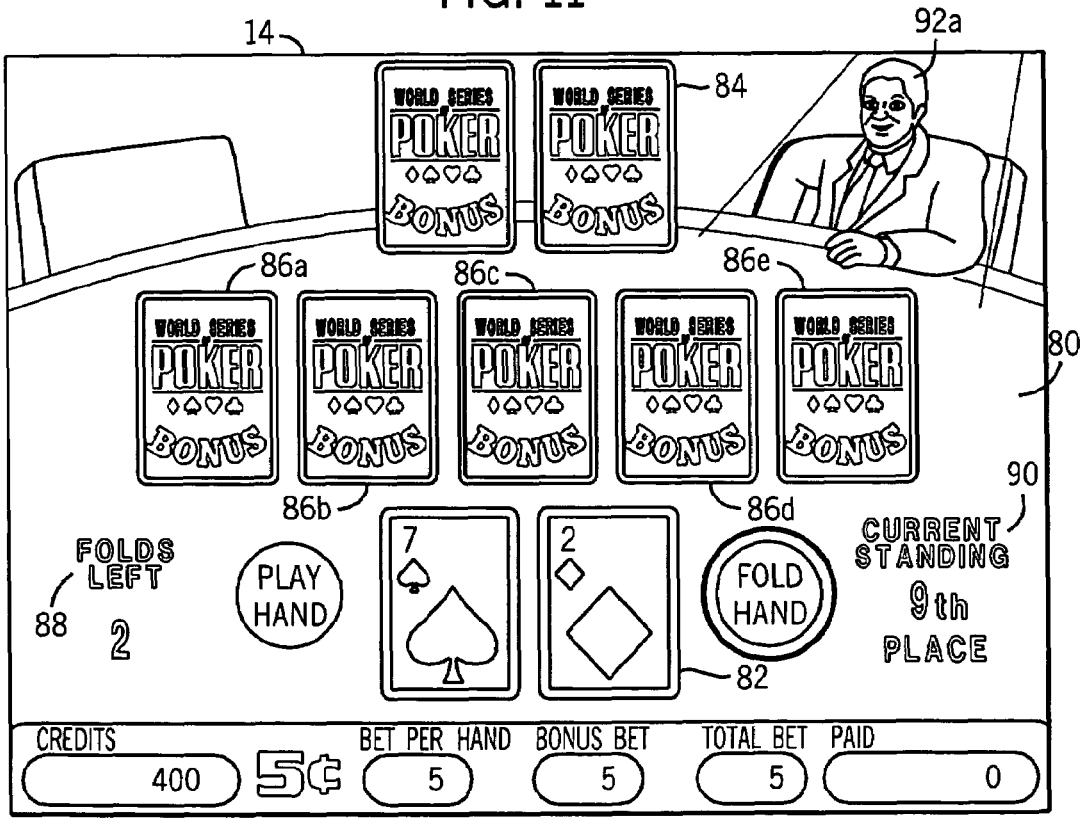
FIG. 12 is a screen display of an alternate round of a bonus poker game.
Figure 13:
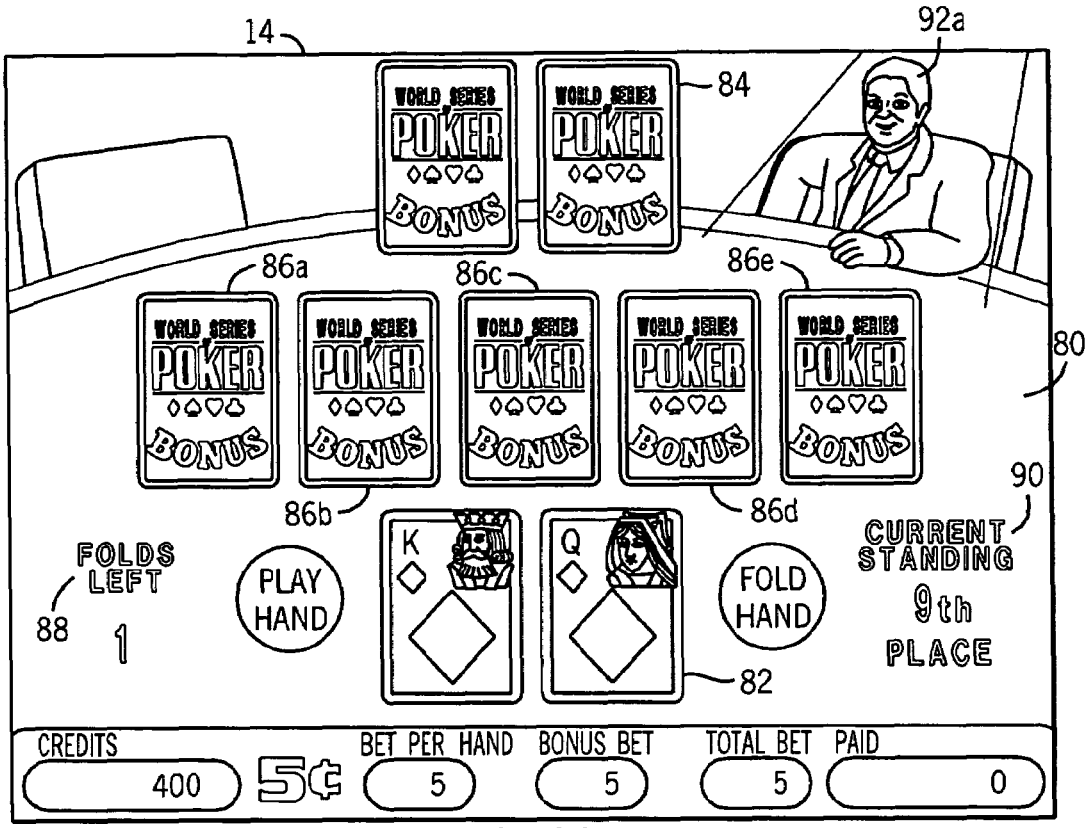
FIG. 13 is a screen display of yet another alternate round of a bonus poker game.

In FIG. 12, a second round of the Final Table Bonus poker game is displayed on the display 14. The player is dealt a new hand 82, and must once again elect to either play the hand or fold the hand via the player input device 24. Here, the player elects to fold his hand 82 of Seven, Two by pressing the "Fold Hand" button, thereby using one of his free folds. In FIG. 13, a replacement hand is dealt to the player, and the player's hand 82 is now King and Queen of Diamonds. The fold meter 88 is decremented as a result of the player's decision to fold the Seven, Two, and now indicates that the player has only one fold remaining. When the fold meter 88 reaches zero, the player has no folds remaining, and must play the hand 82 he is dealt. Thus, the player must exercise judgment and strategy in deciding when to use the fold option to discard weaker starting hands. Here, the player elects to play his hand 82 of King and Queen of Diamonds by pressing the "Play Hand" button.

Figure 14:
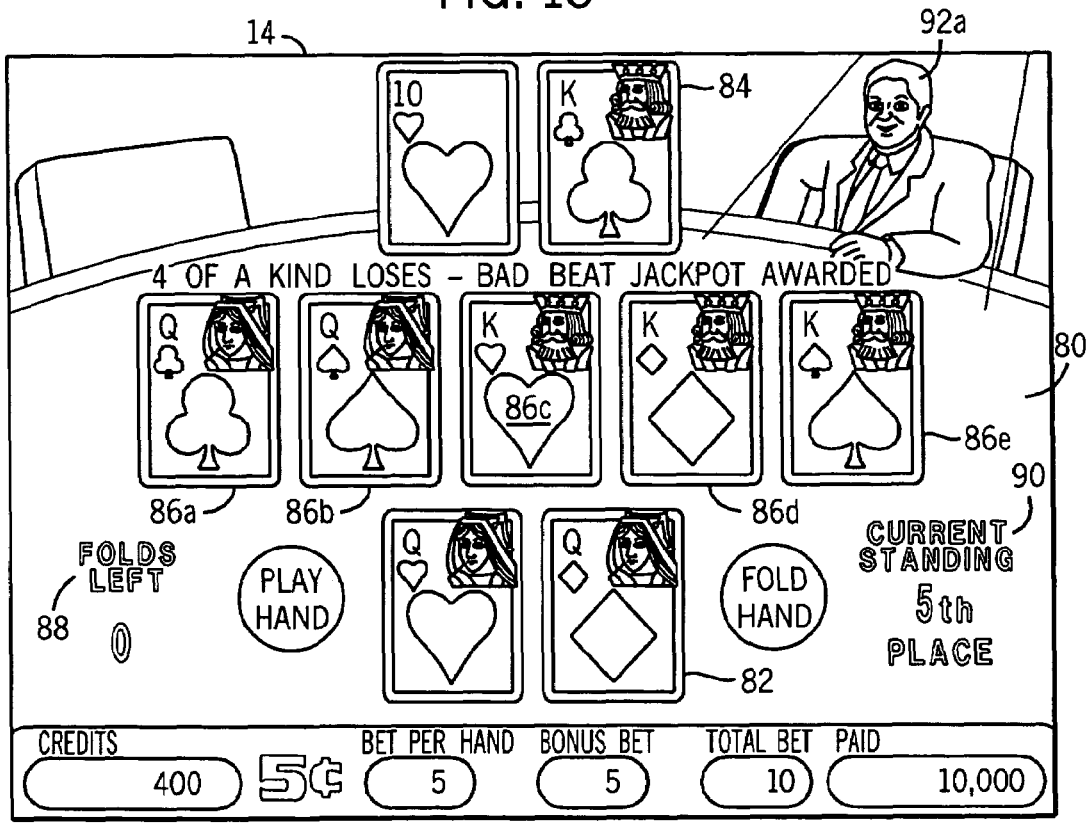
FIG. 14 is a screen display of a bonus poker game displaying a bad-beat bonus award.

Turning to FIG. 14, a subsequent round of the Final Table Bonus is displayed on the display 14. As indicated by the standing meter 90, the player has advanced to the fifth place position. The player has played his hand 82 of pair of Queens. The opponent's hand 84 has been revealed to be a King, Ten, and the community cards 86 have all been displayed. In this case, the opponent 92 has formed a four of a kind, Kings, which beats the player's four of a kind, Queens. Despite the fact that the player's hand 82 has lost to the opponent 92, the player is awarded a bad-beat jackpot for having had a very strong hand defeated. The display 14 indicates to the player that he has been awarded the bad-beat jackpot: "4 of a Kind Loses—Bad Beat Jackpot Awarded!" Thus, the CPU 34 is configured to awarded a player the bad-beat jackpot when the player achieves a hand having a predetermined ranking, but still loses to even a stronger hand. In this embodiment, the bad-beat jackpot is awarded to the player for any four of a kind hand that loses. However, it should be recognized that the bad-beat jackpot may be configured to be awarded for hands having other rankings which are beaten by an opponent's hand 84.

Figure 15:
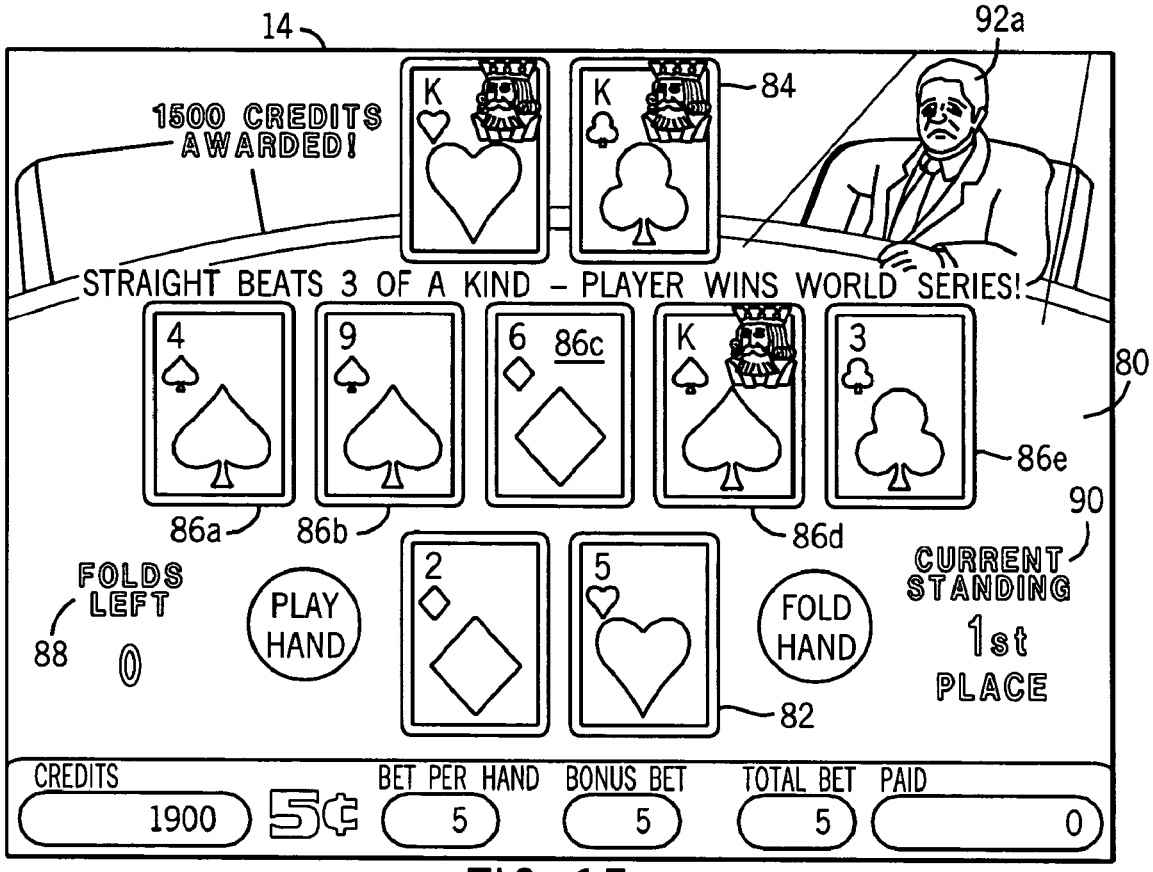
FIG. 15 is a screen display of the conclusion of a bonus poker game.
Figure 16:
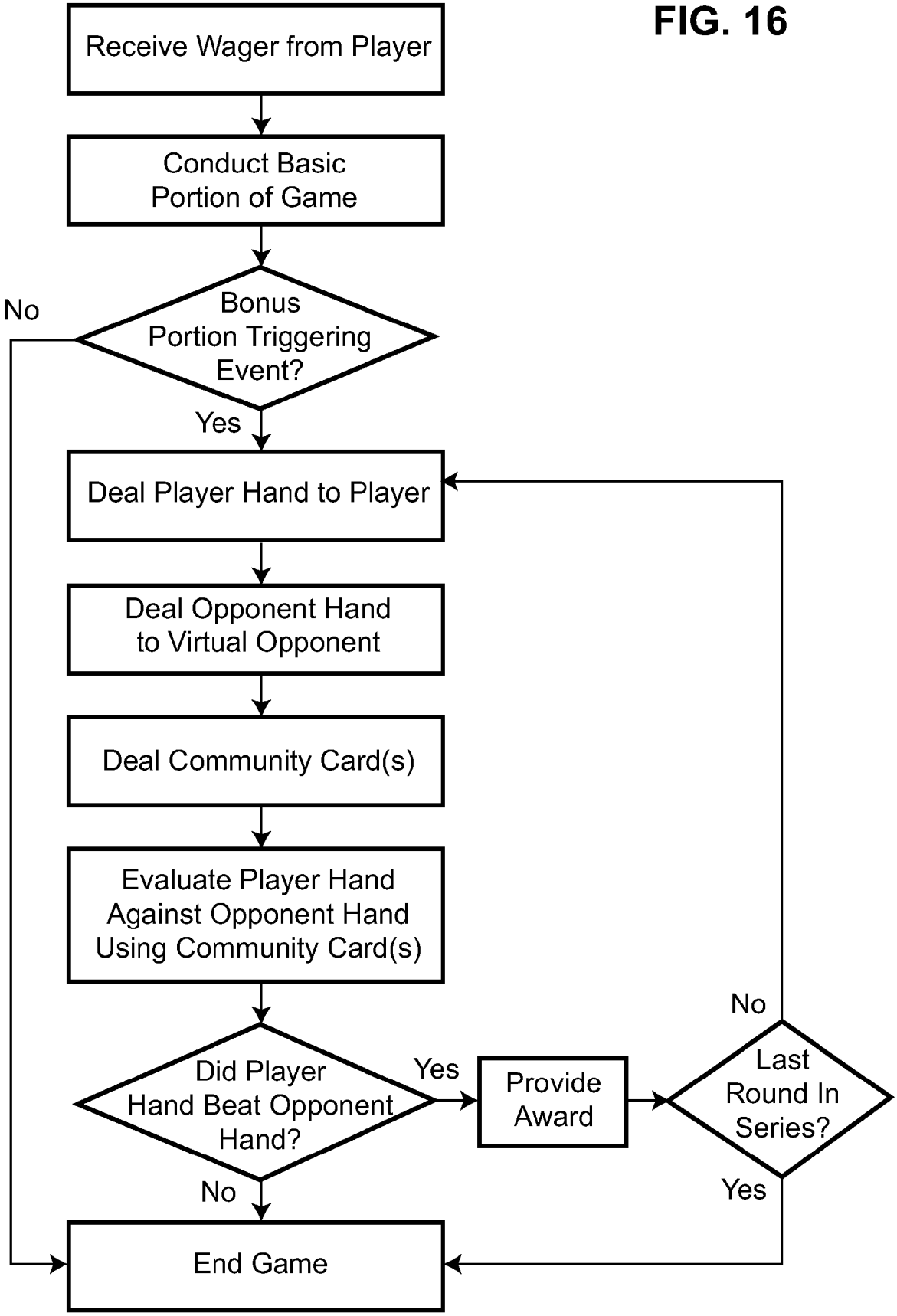
FIG. 16 is a flow chart showing a method of play for a wagering game.

In FIG. 15, the display 14 depicts the player in the Final Table Bonus playing against the final virtual opponent 92*a*. The player's hand 82 consists of a Two, Five, which the player has been forced to play as a result of not having any remaining folds left (fold meter 88 indicates zero). The opponent's hand 86 is a pair of Kings. The community cards 86 are revealed, and the player's hand 82 is evaluated against the opponent's hand 86. Here the player has achieved a straight (Two, Three, Four, Five, Six) which beats the opponent's 92*a* three of a kind (three Kings). Since the player has beaten the last of nine virtual opponents 92, he is awarded the top prize of 1500 credits as indicated by the display 14. Furthermore, the standing meter 90 is incremented to show that the player has achieved a first place standing.

In another embodiment of the invention, the gaming machine 10 may employ an expert advice mechanism, or advisor, displayed or delivered to the player audibly, visually or audio-visually via the primary display 14, secondary display 16, and/or other peripheral devices of the gaming machine 10. Because players often do not know the optimal poker strategy as to which cards to fold, hold, or draw, the expert advice mechanism could be offered to help maximize a player's odds or educate the player as to the consequences of various selections. The advisor may take the form of an animation of a professional poker player providing advice to the player via streaming video. Alternatively, the advisor may be text displayed on the display 14 of the gaming machine 10. Numerous other methods using the audio-visual capabilities of the gaming machine 10 may be employed to provide the advisor to the player. Moreover, the advisor may be continuously available to the player of the gaming machine 10, or may be made available to the player randomly, as a bonus upon achieving certain winning combinations, or upon making an additional wager so as to require the player to purchase the advisor. The advisor purchase option maybe made available before play of the poker game, or during play, either automatically or at the request of the player. The advisor function provides the added bonus of encouraging relatively novice poker players to play the gaming machine 10 due to the added confidence provided by the advisor in maximizing their odds for successful play.

In yet another alternative embodiment, a plurality of networked gaming machines 10 may be configured to allow a plurality of human players to play the poker games disclosed herein against one another rather than against virtual opponents. The plurality of gaming machines 10 may be networked using any number of well known computer networking methods, including hard wired and wireless methods. The networking machines 10 playing the poker games are configured to effectuate a poker tournament amongst human players in a casino (or a plurality of casinos). The networked machines 10 may include a tournament manager, which is preferably a software management tool operating on a server or one of the networked poker machines 10. The tournament manager would function to eliminate or reduce the risk of collusion amongst players in the poker tournament. For example, if two players were allowed to enter and participate in the poker tournament while seated at adjacent gaming machines 10 in the same casino, the two players could coordinate their play by looking at each other's displays 14 on their respective gaming machines. Additionally, unscrupulous players could cheat by watching the play of another player in the tournament. Thus, to prevent this undesirable behavior, the tournament manager would be configured to permit play only on gaming machines 10 not visible from any other machines 10 already enrolled in the tournament. For example, the tournament manager may be configured to permit only one player from each casino in the network to play in the tournament. Alternatively, only one gaming machine 10 from each bank of machines, or from separate physical locations within a casino, may be permitted to enter the tournament. Various other security schemes could be implemented by the tournament manager to lock out selected gaming machines 10 and ensure honest play during the poker tournament. The various features of the poker games described herein, such as the fold meter 88, the odds meter 94, and the advisor may be employed in the networked tournament configuration of the gaming machines 10 as well.

The poker games described herein and executed on the gaming machine 10 may include an "All In" Feature, to mimic a player's ability to go "all in", as with live no-limit tournament poker play. In order to activate play of the gaming machine 10 the player inserts currency via the value input device 18. This money is increases the value of available wagering funds stored in a wagering bank on the machine 10, from which wagers on individual plays of the gaming machine 10 are subtracted. The amount of currency inserted into the machine may be displayed via a credit meter or wagering bank meter on the primary display 14. Additionally, the gaming machine 10 may limit the amount of money that the player can store in the wagering bank to a predetermined value.

The All In Feature would permit the player to wager any amount up to and including the entire amount of money available in the wagering bank during play of the bonus poker game described herein. Thus, during the Final Table Bonus, as with traditional no-limit poker, the player would be permitted to activate the All In Feature to increase his wager after viewing the player's hand 82, but prior to viewing the opponent's hand 84. Alternatively, the All In Feature could be activated at any time against any of the virtual opponents 92, including after the display of the opponent's hand 84 or one or more of the community cards 86. In another alternative embodiment, the poker game may be configured to reveal the opponent's hand 84 to the player only after the All In Feature has been activated.

Preferably the All In Feature would be correlated to a dynamic paytable which may be, at least in part, based upon the odds of the player's hand 82 defeating the opponent's hand 84. For example, in FIG. 9, the odds meter 88 displays that the player's hand 82 of a pair of Aces is 76% favored to win against the opponent's hand 84 of King, Jack. Thus, if the player were to activate the All In Feature to increase the amount of his wager, the corresponding payout via the dynamic paytable would be adjusted such that the house advantage remains constant, or within a predetermined range. The odds of the player's hand 82 winning would affect the payout by increasing the payout for hands with relatively lower chances of success of winning and decreasing the payout for hands with relatively higher success of winning. Moreover, hands with relatively high probabilities of winning may pay out less than even money. Thus, a player going "All In" with a strong hand for the full value of his wagering bank (e.g. 100 credits), may only receive a relatively small payout (e.g. 20 credits) for his success based upon the odds of the player's hand 82 winning being high. Preferably, the dynamic paytable is dependent upon other factors besides the odds of a particular hand winning, including coins bet and desired house advantage. In this way, the paytable dynamically adjusts the payouts on particular plays of the game to maintain a desired house advantage. Furthermore, the All In Feature may be employed in the networked gaming machine 10 scenario described herein to allow players at various gaming machines 10 competing against other players to increase their wagers during play.

The poker game and the bonus poker game of the present invention offer substantial advantages over traditional video poker games. The bonus hand 70 played in conjunction with the first poker hand 60 offers the player an opportunity to improve his winnings on the first poker hand 60 while at the same time serving as a trigger to the bonus poker game. The bonus poker game offers the player substantial excitement and anticipation by allowing the player to compete against virtual opponents 92 as if playing in a poker tournament setting. The fold option indicated by the fold meter 88 allows the player to exercise strategy and skill decisions in evaluating and folding weaker hands. The bad-beat bonus awards players who lose despite having strong hands containing winning combinations. Furthermore, the odds meter 94 adds to the thrill and excitement of playing the game by indicating to the player the statistical chances of his hand 82 beating an opponents hand 84.

Each of these embodiments and obvious variations thereof is contemplated as falling within the spirit and scope of the claimed invention, which is set forth in the following claims.

What is claimed is:

1. A method of conducting an electronic wagering game via a gaming machine, the method comprising:

receiving a wager via an input interface associated with the gaming machine;

conducting a basic portion of the wagering game; and in response to a triggering event, conducting a bonus portion of the wagering game using a processor associated with the gaming machine, the bonus portion including a series of at least three possible rounds against respective virtual opponents, each round including:

dealing a player hand to the player, the player hand including a first plurality of starting cards;

dealing an opponent hand to the respective virtual opponent, the opponent hand including a second plurality of starting cards;

dealing at least one community card;

evaluating the player hand against the opponent hand using the at least one community card; and if the player hand beats the opponent hand, providing an award and advancing the player to a next round in the series if the current round is not the last in the series, wherein at least one round includes providing the player with an opportunity to fold and obtain a replacement hand.

2. A method of conducting an electronic wagering game via a gaming device, the method comprising:

receiving a wager via an input interface associated with the gaming device;

conducting a basic portion of the wagering game; and in response to a triggering event, conducting a bonus portion of the wagering game using a processor associated with the gaming device, the bonus portion including a series of at least three possible rounds against respective virtual opponents, each round including:

dealing a player hand to the player, the player hand including a first plurality of starting cards;

dealing an opponent hand to the respective virtual opponent, the opponent hand including a second plurality of starting cards;

dealing at least one community card;

evaluating the player hand against the opponent hand using the at least one community card; and if the player hand beats the opponent hand, providing an award and advancing the player to a next round in the series if the current round is not the last in the series, wherein the series includes providing the player with a predetermined number of opportunities to fold and obtain a replacement hand.

3. The method of claim 2, wherein the predetermined number is two.

4. A method of conducting an electronic wagering game via a gaming machine, the method comprising:

receiving a wager via an input interface associated with the gaming machine;

conducting a basic portion of the wagering game; and in response to a predetermined event and using a processor associated with the gaming machine, conducting a multi-level card game as a bonus portion of the wagering game, the multi-level card game including a series of at least three possible rounds against one or more virtual opponents, each round including:

dealing a hand to the player;

dealing a hand to a selected one of the virtual opponents;

evaluating the player hand against the virtual opponent hand; and if the player has not defeated all of the virtual opponents, advancing the player to a subsequent round with a different virtual opponent associated with a higher award level if the player hand beats the virtual opponent hand in the current round, wherein at least one of the rounds includes providing the player with an opportunity to fold and obtain a replacement hand.

5. A method of conducting an electronic wagering game via a gaming machine, the method comprising:

receiving a wager via an input interface associated with the gaming machine;

conducting a basic portion of the wagering game; and in response to a predetermined event, conducting a multi-level card game as a bonus portion of the wagering game using a processor associated with the gaming machine, the multi-level card game including a series of at least three possible rounds against one or more virtual opponents, each round including:

dealing a hand to the player;

dealing a hand to a selected one of the virtual opponents;

evaluating the player hand against the virtual opponent hand; and if the player has not defeated all of the virtual opponents, advancing the player to a subsequent round with a different virtual opponent associated with a higher award level if the player hand beats the virtual opponent hand in the current round, wherein at least one of the rounds includes providing the player with a predetermined number of opportunities to fold and obtain a replacement hand.

6. The method of claim 5, wherein the predetermined number is two.

7. The method of claim 5, wherein the predetermined number of opportunities to fold and obtain a replacement hand are the only opportunities to fold and obtain a replacement hand presented to the player during the multi-level card game.

* * * * *